US009559440B2

(12) United States Patent
Wendt et al.

(10) Patent No.: US 9,559,440 B2
(45) Date of Patent: Jan. 31, 2017

(54) LEAD-THROUGH TERMINAL AND ELECTRICAL COMPONENT

(71) Applicant: PHOENIX CONTACT GMBH & CO. KG, Blomberg (DE)

(72) Inventors: Andreas Wendt, Berlin (DE); Ralf Beckmann, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/023,701

(22) PCT Filed: Sep. 12, 2014

(86) PCT No.: PCT/EP2014/069503
§ 371 (c)(1),
(2) Date: Mar. 22, 2016

(87) PCT Pub. No.: WO2015/039963
PCT Pub. Date: Mar. 26, 2015

(65) Prior Publication Data

US 2016/0218450 A1 Jul. 28, 2016

(30) Foreign Application Priority Data

Sep. 23, 2013 (DE) ..... 10 2013 110 477

(51) Int. Cl.
*H01R 4/48* (2006.01)
*H01R 4/50* (2006.01)
(Continued)

(52) U.S. Cl.
CPC ..... *H01R 4/5008* (2013.01); *H01R 4/4836* (2013.01); *H01R 9/24* (2013.01); *H01R 13/743* (2013.01)

(58) Field of Classification Search
CPC ..... H01R 4/48
(Continued)

(56) References Cited

U.S. PATENT DOCUMENTS 4,700,997 A * 10/1987 Strand ..... A61B 5/0416 439/370
4,768,969 A * 9/1988 Bauer ..... A61B 18/16 439/260

(Continued)

FOREIGN PATENT DOCUMENTS

DE 4239480 A1 5/1994
DE 102008024366 A1 11/2009
EP 2605335 A2 6/2013

*Primary Examiner* — Neil Abrams
(74) *Attorney, Agent, or Firm* — Leydig, Voit & Mayer, Ltd.

(57) ABSTRACT

A lead-through terminal for connecting a conductor so as to conduct electricity includes: a terminal housing having a bearing portion that abuts a wall of an electrical installation when in an installed state, the bearing portion defining on the terminal housing a first housing portion on a first side and a second housing portion on a second side of the bearing portion, a wall feedthrough being provided on the bearing portion; and a pivotable actuation device being provided on the terminal housing to clamp the conductor in a contact position on a current bar and to release the conductor when in an open position. The actuation device is located on the first side to a greater extent when in the contact position than when in the open position, in which the actuation device extends through the wall feedthrough onto the second side at least in part.

19 Claims, 5 Drawing Sheets

(51) Int. Cl.
*H01R 9/24* (2006.01)
*H01R 13/74* (2006.01)

(58) Field of Classification Search
USPC ..... 439/835, 838, 729
See application file for complete search history.

(56) References Cited

U.S. PATENT DOCUMENTS

| | | | | |
|---|---|---|---|---|
| 5,575,695 | A * | 11/1996 | De Bernardis | H01R 4/4818 439/441 |
| 6,238,233 | B1 * | 5/2001 | Drexler | H01R 4/2412 439/409 |
| 6,712,649 | B2 * | 3/2004 | Mano | H01R 4/4845 439/441 |
| 8,388,358 | B2 * | 3/2013 | Thompson | H01R 4/4827 439/76.1 |
| 8,430,674 | B2 * | 4/2013 | Pichard | H01R 4/4827 439/44 |
| 8,480,424 | B2 * | 7/2013 | Koellmann | H01R 4/4845 439/358 |
| 8,727,819 | B2 * | 5/2014 | Giefers | H01R 4/489 439/441 |
| 8,771,027 | B2 * | 7/2014 | Zhang | H01R 4/4809 439/835 |
| 8,794,994 | B2 * | 8/2014 | Kollmann | H01R 4/4836 439/441 |
| 9,219,332 | B2 * | 12/2015 | Wendt | H01R 13/629 |
| 9,385,443 | B2 * | 7/2016 | Moser | H01R 4/4836 |
| 9,425,519 | B2 * | 8/2016 | Wendt | H01R 4/5008 |
| 2011/0073364 | A1 | 3/2011 | Reibke | |
| 2014/0370740 | A1 | 12/2014 | Köllmann et al. | |
| 2016/0056548 | A1 * | 2/2016 | Wendt | H01R 4/5008 439/725 |
| 2016/0218450 | A1 * | 7/2016 | Wendt | H01R 4/4836 |

* cited by examiner

LEAD-THROUGH TERMINAL AND ELECTRICAL COMPONENT

CROSS-REFERENCE TO PRIOR APPLICATIONS

This application is a U.S. National Phase application under 35 U.S.C. §371 of International Application No. PCT/EP2014/069503, filed on Sep. 12, 2014, and claims benefit to German Patent Application No. DE 10 2013 110 477.0, filed on Sep. 23, 2013. The International Application was published in German on Mar. 26, 2015 as WO 2015/039963 A1 under PCT Article 21(2).

FIELD

The present invention relates to an electrical lead-through terminal and to an electrical installation comprising such a lead-through terminal for connecting at least one conductor.

BACKGROUND

The prior art discloses a wide variety of lead-through terminals that are suitable for use on switchgear cabinets or other electrical apparatuses. In the process, the lead-through terminal is mounted on a wall or a housing of an electrical installation in such a way that a part of the lead-through terminal can be accessed from inside while a conductor can be connected from the outside. Often, screw terminals or spring clamps are used for the contact connections inside and outside. The disadvantage of the known lead-through terminals is the relatively high amount of space required.

SUMMARY

A lead-through terminal for connecting a conductor so as to conduct electricity includes: a terminal housing having a bearing portion that abuts a wall of an electrical installation when in an installed state, the bearing portion defining on the terminal housing a first housing portion on a first side and a second housing portion on a second side of the bearing portion, a wall feedthrough being provided on the bearing portion; and a pivotable actuation device being provided on the terminal housing to clamp the conductor in a contact position on a current bar and to release the conductor when in an open position. The actuation device is located on the first side to a greater extent when in the contact position than when in the open position, in which the actuation device extends through the wall feedthrough onto the second side at least in part.

BRIEF DESCRIPTION OF THE DRAWINGS

The present invention will be described in even greater detail below based on the exemplary Figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
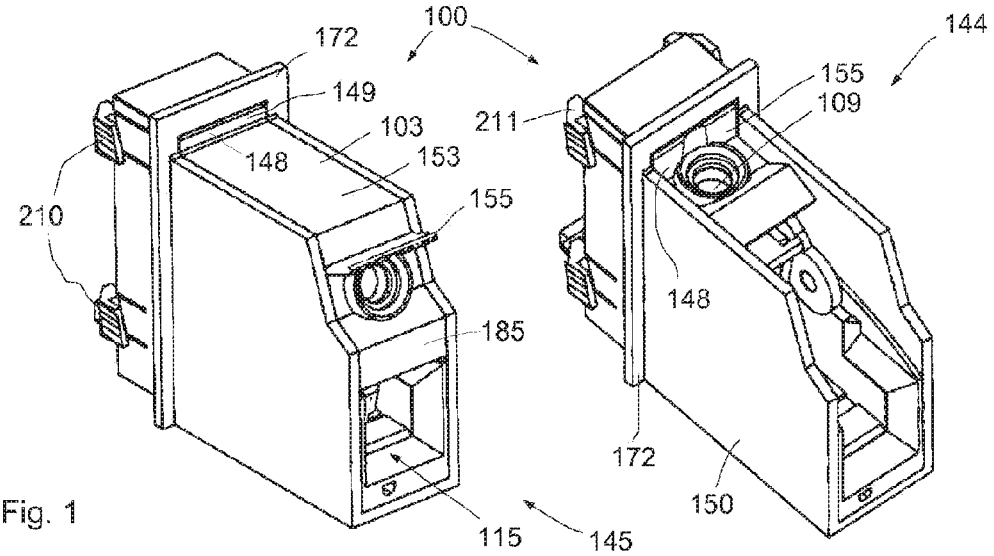
FIG. 1 is a perspective view of a lead-through terminal in the contact position and open position.

A lead-through terminal according to the invention is particularly suitable for connecting conductors of large cross sections. In principle, the lead-through terminals can be used on any electrical installations. It is possible, for example, to use a lead-through terminal on switchgear cabinets, but also on electrical apparatuses or devices such as, for example, electricity meters or smart meters.

A lead-through terminal according to the invention for connecting a conductor so as to conduct electricity comprises a terminal housing having at least one bearing portion intended for abutting a wall of an electrical installation when in the installed state. In the process, on the terminal housing the bearing portion defines a first housing portion on a first side and a second housing portion on a second side of the bearing portion. A wall feedthrough is provided on the bearing portion. A pivotable actuation device is arranged on the terminal housing in order to clamp the conductor on a current bar when in a contact position and to release and/or hold said conductor when in an open position. In the process, the actuation device is located on the first side to a greater extent when in the contact position than when in the open position. In the open position, the actuation device extends through the wall feedthrough onto the second side at least in part.

The lead-through terminal according to the invention has many advantages. One significant advantage of the lead-through terminal according to the invention is that the actuation device is provided so as to be pivotable and is arranged such that, in the event of a pivot movement when moving from the contact position into the open position, the actuation device extends through the wall feedthrough onto the second side at least in part. As a result, some of the space behind the wall of the electrical installation is also used, at least when actuating the lead-through terminal. Therefore, the lead-through terminal can be produced to be smaller overall since the installation space on the second side of the bearing portion and thus inside the electrical installation is also used. The installation space outside the electrical installation can thus be reduced. The total installation space of the lead-through terminal can also be reduced.

The bearing portion can be in the form of a bearing wall that extends at least partly around the periphery or around the entire periphery. It is also possible for the bearing portion to comprise two, three, four or more bearing supports, by which the terminal housing abuts and is supported on the housing or the wall of the electrical installation.

When in the correctly installed state, it is preferable in all embodiments for the first housing portion to be located substantially on a first side of the wall of the electrical installation and for the second housing portion to be arranged substantially on a second side of the wall of the electrical installation. In this case, the second side is routinely understood to be the interior of the electrical installation. By contrast, the first side remains outside the housing of the electrical installation.

In the open position, at least a significant part of the actuation device is preferably arranged on the second side. In this case, the extent is understood in particular to be the volume and/or the mass and/or the cross-sectional surface of the actuation device.

The actuation device passes through the wall at least in part when moving into the open position, and remains at least substantially on the outside when in the contact position.

In advantageous developments, the actuation device is located inside the first housing portion to a greater extent when in the contact position than when in the open position. More particularly, the actuation device or at least a part of the actuation device is located further inside the first housing portion when in the contact position.

In all embodiments, it is preferable for the second housing portion to function as an attachment portion and in particular to comprise at least one latching unit. The latching unit is suitable in particular for abutting a wall of an electrical installation or locking thereon.

In advantageous developments, at least one latching unit is formed as a resilient latching arm, which is U-shaped at its free end. Preferably, at least one latching element is provided on the returning leg of the free end.

At its free end, the resilient latching arm comprises practically one leg extending away from the terminal housing and a returning leg which is in parallel or approximately in parallel therewith and extends at least some way further back again from the free end.

The returning leg preferably comprises at least one latching element. Between the two legs, a clearance in the form of a latch groove is in particular provided, which can also be referred to as a retaining groove or support groove. Particularly preferably, four resilient latching arms are provided.

Preferably, at least one counter-bearing portion for supporting at least one latching unit is provided on the second housing portion. The counter-bearing element can, for example, be in the form of a wall element.

It is particularly preferable for the second housing portion to form an overall approximately peripheral housing contour. A peripheral housing contour of this type in particular covers the actuation device at least substantially from all lateral directions in the open position. This provides a guard for the actuation device, so that the risk of accidental mechanical contact with the actuation device can be largely prevented. Since such a housing contour preferably consists of a non-conductive material, for example plastics material, effective contact protection is also ensured for the actuation device.

Preferably, the counter-bearing elements and/or the latching units are part of the peripheral housing contour or form said contour. A design of this type can ensure that the terminal housing of the lead-through terminal is reliably fitted on the housing of an electrical installation. It is likewise ensured that the installation space required by the actuation device or by parts of the actuation device during pivoting is reliably provided within the second housing portion. This prevents the available space from being deformed or reduced, e.g. by deformations of the resilient latching arms, such that it is no longer possible to pivot the actuation device into the second housing portion or not possible to do so without friction. Owing to these measures, overall the installation volume of the lead-through terminal can be significantly reduced and optimised.

Preferably, the actuation device comprises a cover device in the form of a cover, a protective cover or a covering housing. In particular, a tool access is provided on the cover, by which access a tool can be positioned on the actuation device in order to move the actuation device from the contact position into the open position or back again.

In preferred embodiments, the actuation device comprises at least one clamping lever for clamping the conductor and at least one clamping spring for applying a clamping force.

Preferably, the cover is attached to an insert device and in particular to at least one latching lug of the insert device. The insert device is in particular held on the clamping spring.

In this case, the clamping spring preferably comprises a first leg and at least one second leg. The insert device is held in particular between the two legs of the clamping spring.

Preferably, the clamping spring is hingedly coupled to the clamping lever by the first leg and hingedly coupled to the auxiliary lever by the second leg. In the process, the clamping lever and the auxiliary lever are pivotally held on the mount. An embodiment of this type allows high clamping forces to be applied while only a small operating force is necessary at the same time.

Preferably, a first pivot pin and at least one pivot pin spaced apart therefrom are arranged on the clamping lever. The clamping spring preferably has a first pin receptacle and at least one second pin receptacle spaced apart therefrom. In addition, an auxiliary lever is preferably provided, which has a first rotary unit and at least one second rotary unit spaced apart therefrom.

In the lead-through terminal, the opening angle between the current bar and the clamping lever in the open state is preferably greater than 45° and in particular greater than 60° and preferably greater than 75°. The opening angle between the current bar and the clamping lever and in particular between the current bar and a clamping edge of the clamping lever can also be 90° or even greater.

An electrical installation according to the invention comprises a housing having at least one wall. At least one lead-through terminal is held on the wall and is used to connect at least one conductor to at least one current bar so as to conduct electricity. The lead-through terminal comprises a terminal housing having at least one bearing portion. The at least one bearing portion preferably abuts the wall at least in part. On the terminal housing, the bearing portion defines a first housing portion on a first side and a second housing portion on a second side of the bearing portion. A wall feedthrough is provided on the bearing portion. A pivotable actuation device is arranged on the terminal housing in order to be able to clamp the conductor on a current bar when in a contact position and to release and/or hold said conductor when in an open position. In the process, the actuation device is located on the first side to a greater extent when in the contact position than when in the open position. In the open position, the actuation device extends through the wall feedthrough onto the second side at least in part.

The electrical installation according to the invention has many advantages since it has a simple construction and can be designed to be compact. By making use of the unused space on the other side of the wall inside the electrical installation, the available installation space can be used more effectively overall. In general, the installation space and housing volume required for the lead-through terminal can be reduced.

Preferably, the first housing portion of the terminal housing is arranged at least substantially outside the housing and thus outside the electrical installation. Furthermore, the second housing portion of the housing is preferably provided at least substantially inside the housing and thus inside the electrical installation.

In the case of the lead-through terminal, the terminal housing preferably comprises at least two components, specifically an inner housing and an assembly carrier for the metal parts or a mount that consists in particular of metal and is used to receive the other parts. Furthermore, an outer housing can be provided, which is used to receive the mount and the inner housing. The outer housing can optionally also be integrally moulded or formed on an existing electrical installation. The outer housing and/or the inner housing preferably consists of plastics material.

The structural design with the mount and a terminal housing for receiving the mount allows large air and creepage distances to be created and adhered to in a simple manner.

Hereinafter, the design and the functioning of a lead-through terminal 100 and an electrical installation 500 equipped with at least one such lead-through terminal will be explained with reference to the accompanying drawings.

In this case, FIG. 1 shows two perspective views, side by side, of a lead-through terminal 100, specifically in the clamping state or the contact position 145 on the left and in the open state or open position 144 next to it on the right.

Figure 2:
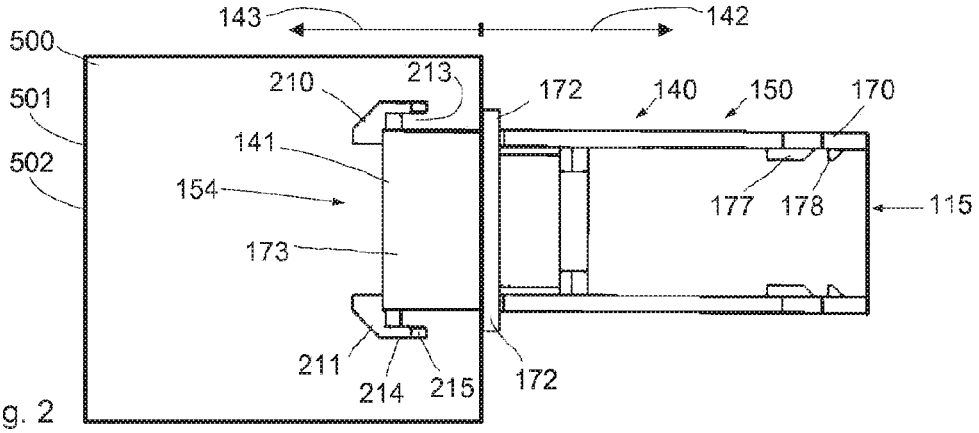
FIG. 2 is a schematic plan view of a wall of an electrical installation having a terminal housing held thereon.

The lead-through terminal 100 comprises a terminal housing 150 and is intended for abutting a wall 502 of an electrical installation 500 by means of the bearing portion 172 (cf. FIG. 2). In the contact position 145, the conductor receptacle 115 is largely closed, while a particularly large opening angle between the current bar and the clamping lever of possibly 75° or more is produced in the open position 144. As a result, it is made simpler to pivot a conductor (cf. FIG. 11) into the conductor receptacle 115, which can greatly simplify the connecting process, in particular with conductors having a cross section of several square millimeters.

The terminal housing 150 consists in particular of an electrically non-conductive material and preferably of a plastics material. The bearing portion 172 can be provided as a peripheral ridge by which the lead-through terminal 100 is supported peripherally on the wall 502. It is also possible for the bearing portion 172 to consist of a plurality of segments or individual supporting elements.

The tool opening 109, which is provided in the actuation device 103, is visible on the lead-through terminal 100 both in the contact position 145 and the open position 144. The actuation device 103 comprises a covering housing in the form of a cover 153. The cover 153 in this case consists of an insulating material and protects the interior of the actuation device 103 and also the interior of the lead-through terminal 100 from mechanical contact. The air and creepage distances are also considerably increased by the cover 153.

The terminal housing 150 can comprise an outer housing 170 and an inner housing 160, on which the mount 108 is held. The mount 108 preferably consists of metal and in particular of a punched bent part. The outer housing and inner housing preferably consist of a plastics material. During assembly, the mount 108 is held on the inner housing 160 and the necessary metal parts and clamping parts are mounted. Together with the mount 108, the inner housing forms a pre-assembled structural unit, which then merely has to be placed in the outer housing 170, or inserted or locked into an outer housing that is already present on an electrical installation 500 and, for example, formed thereon integrally with the wall.

The lead-through terminal 100 comprises the pivotable actuation device 103. By pivoting the actuation device 103, the lead-through terminal can be opened or closed again. When pivoting the actuation device 103, a gap 148 can be produced between the peripheral wall of the bearing portion 172 and the cover 153 of the actuation device 103, specifically at the point where the closure ridge 149 is located when in the contact position 145. If the actuation device 103 is pivoted backwards from the closed position shown on the left in FIG. 1, the closure ridge 149 is pivoted through the wall feedthrough 154 and thus through the wall 502 into the electrical installation 500. At the same time, a gap 148 is also produced between the wall 172 and the cover 153 at the point where the closure ridge 149 was arranged previously. Upon further pivoting into the open position 144, the gap 148 is finally closed by the deflector 155, and so there is no gap 148 in the open position. The gap 148 is at a distance from the conductor receptacle 115 and is independent of the conductor receptacle 155.

FIG. 2 is a highly schematic plan view of an electrical installation 500 comprising a wall 502, on which a lead-through terminal 100 is held, only the outer housing 170 thereof being shown in FIG. 2 for the sake of clarity. Inside the outer housing 170, lugs 177 and 178 are provided, on which the inner housing 160 is locked during assembly.

The shape of the latching units 210, which are formed as latching arms 211, can be seen in FIG. 2. The legs of the latching arms 211, which legs extend away from the terminal housing 150, are covered in this case by the support wall that also acts as the counter-bearing element 173. In this case, the width of the support wall 173 corresponds exactly to the external spacing of the two latching arms 211 visible in FIG. 2. As will be explained with reference to FIG. 4, this ensures that the latching arms can briefly resiliently pivot inwards when they are installed on the wall 502, yet are later retained on the outside by the latching units 220 that interact with the latching arms, and so the cross section of the wall feedthrough 154 remains free.

Figure 3:
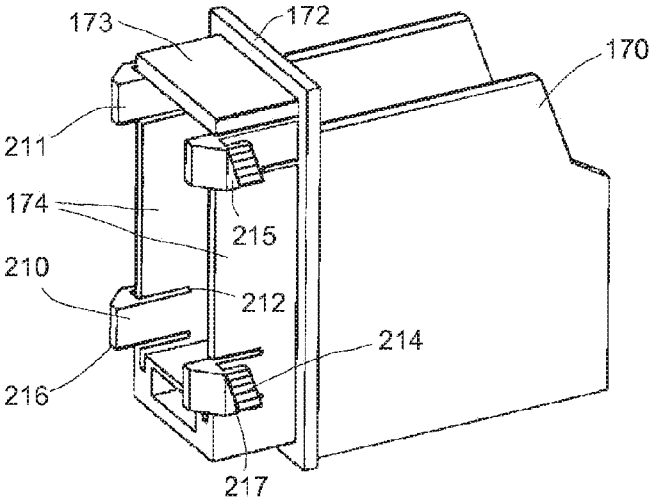
FIG. 3 is a perspective view of a terminal housing.

FIG. 3 is a perspective view of the terminal housing 150 or the outer housing 170 thereof, comprising the first housing portion 140 on a first side 142 of the bearing portion 172 and thus outside the electrical installation 500. The second housing portion 141 is arranged inside the housing 501 on the second side 143. The second housing portion 141 is used here as an attachment portion, on which the counter-bearing elements 173, together with the latching arms 211 and the walls 174, provide a peripheral wall. As a result, the interior of the second housing portion 141 is mechanically protected from influences and contact if, for example, part of the actuation device 103 enters the second housing portion 141.

The latching arms 211 are approximately U-shaped at the free ends 216. Between the returning leg 215 and the latching arm 211, a groove 213 is provided, which a part of the latching unit 220 enters.

An engagement unit 217 is provided on the outer oblique surface 214 and is formed here as a latching toothing or a plurality of latching teeth. The latching toothing 217 on the opposite latching arms 211 is arranged in each case on the outer surfaces that face away from one another and which are each transverse to the transverse direction 204 (cf. FIG.

4). The outer surfaces can be arranged perpendicularly to the transverse direction 204, but are in particular arranged at a small angle thereto of between 0° and 30°.

Owing to the grooves 212 between the side wall and the latching arms 211, the latching arms 211 can resiliently deflect during assembly.

Figure 4:
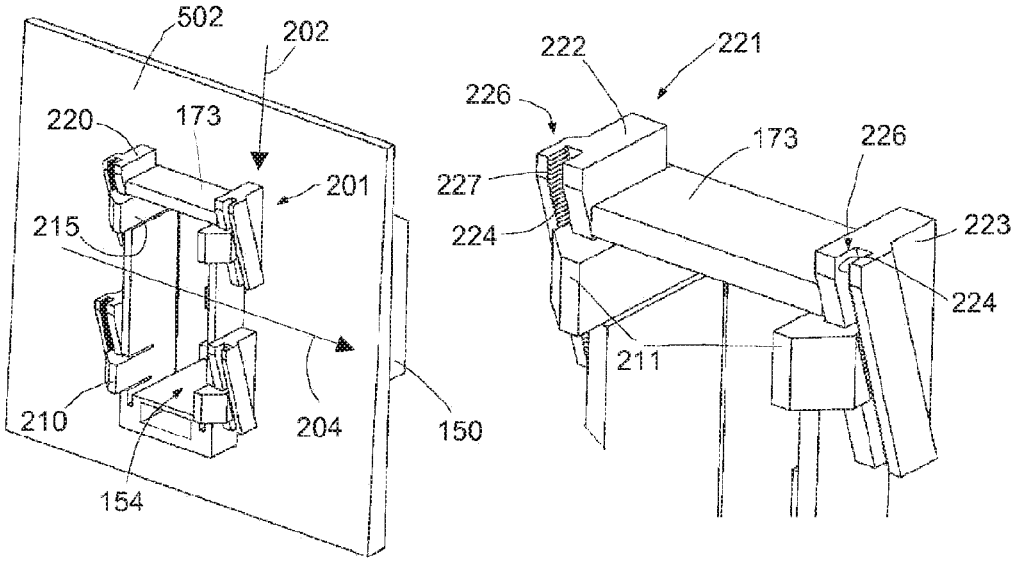
FIG. 4 is a schematic perspective view of a wall of an electrical installation having a terminal housing held thereon, and of an enlarged detail thereof.

FIG. 4 shows a lead-through terminal 100 installed on a wall 502 of an electrical installation 500, in which a part of the second housing portion 141 of the terminal housing 150 can be seen schematically behind the wall 501. In principle, however, the terminal housing 150 is also suitable for use in other electrical connection terminals.

Figure 5:
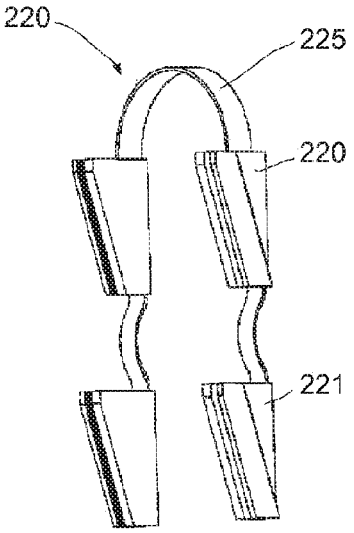
FIG. 5 shows a different latching unit for the terminal housing according to FIG. 4.

To attach the lead-through terminal 100, a locking system 201 is provided, which in this case comprises four latching units 210 and four latching units 220. The latching units 210 are in the form of latching arms 211 which are resiliently held on the terminal housing 150 and extend as far as to their free end 216, where the latching arms 211 are U-shaped, and so the latch groove 213 is suitable for receiving the latching units 220. The latching units 220 designed as latch connectors 221 can be individual separate parts, as shown in FIG. 4, or they can be interconnected, for example by means of a flexible connector 225 or a clip, as shown in the enlarged view in FIG. 5.

Each latching connector 221 comprises a latching body 222, which has an approximately cuneiform structure 223 so as to thus be able to bring about clamping on walls 502 of different thicknesses.

For installation, the second housing portion 141 of the terminal housing 150 is inserted through the opening in the wall 502, the resilient latching arms 211 briefly resiliently bending inwards when the latching arm 211 in question passes through the wall 502. After this, the latching arms 211 snap outwards again. The terminal housing 150 then cannot be easily removed again. To attach the terminal housing 150, the latching units 220 are then placed on. In the process, the latching connectors 221 are placed, with their groove 226, on the legs 215 of the latching arms 211, and so the latching elements 217 are brought into a latching connection, on their oblique surface 224, with the latching toothing 227 on the latching connectors 221. When the latching connectors 221 move in the latching direction 202, the ends of the latching arms 211 are clamped by the cuneiform latching bodies 222 of the latching connectors 221 and are pushed away from the wall 502. In this way, secure retention can be ensured even with different wall thicknesses or cuneiform or step-like walls 502. In the process, the latching toothing 227 extends transversely to the connection direction. The latching toothings 217 and 227 are each provided on oblique surfaces 214 and 224, respectively, which abut one another when in the installed state.

In this case, clamping takes place at each of the four individual latching arms 211, and so even different wall thicknesses do not affect the individual latching arms 211.

In the installed state, as shown in FIG. 4, the support wall 173 forms a counter-bearing element, against which the adjacent latching arms 211 are supported. This ensures that the wall feedthrough 154 or the space between the support walls 173 remains free. If, after being inserted into the wall 502, a resilient latching arm 211 does not resiliently bend back outwards by itself, the latching arm 211 is pulled outwards by the latching connectors 221, since the latching connectors 221 are supported on the support wall 173, acting as a counter-bearing, by their latching bodies 222.

In this way, reliable functioning of the lead-through terminal 100 can be ensured, since the clamping spring 101 and other components of the actuation device are partly pivoted through the wall feedthrough 154 when the actuation device 103 moves from the contact position 145 into the open position 144. Therefore, it has to be ensured that the installation space inside the electrical installation 500 that the second housing portion 141 occupies does not create any obstructions during the pivot movement.

Figure 6:
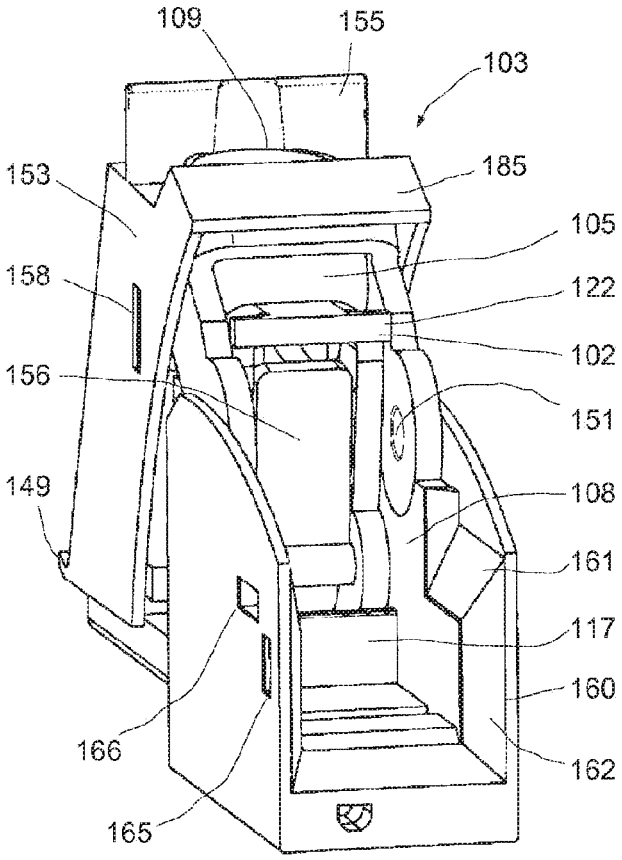
FIG. 6 is a schematic perspective view of an open lead-through terminal without an outer housing.

FIG. 6 is a schematic perspective view of an open lead-through terminal 100 without an outer housing 170 but having an installed plastics inner housing 160 on which the metal mount 108 is held. The mount 108 of the lead-through terminal 100 has an approximately U-shaped cross section and consists in this case of a punched bent part. The current bar 110 is held on the mount 108.

The lead-through terminal 100 is shown in the open position 144, in which a conductor to be connected can be pivoted into the conductor receptacle 115 from above. A conductor can optionally also be inserted from the front.

Chamfers 161 and 162 acting as insertion aids are provided at the conductor receptacle 115 in the plastics wall of the inner housing 160. The latch openings 165 and 166 in the outer side walls are intended for holding the lugs 177 and 178 on the inner walls of the outer housing 170, as a result of which the terminal housing is fixed together in itself.

The actuation device 103 is covered by a cover 153. The closure ridge 149, which closes a gap 148 between the bearing wall or the bearing portion 172 and the wall feedthrough 154 in the contact position 145, is provided on the cover 153. In the open position 144, the deflector 155 closes the gap 148. In the contact position 145, the wall 185 covers the conductor receptacle 115 at the top. Furthermore, the wall 185 can define an insertion funnel for a tool. An insertion funnel of this type can be provided if side walls connect the deflector 155 and the wall 185, so the tool receptacle 109 is surrounded by walls in a funnel-shaped manner.

On the side, an opening 158 in the cover 153 can be seen, by which opening an insert device 118 having protrusions 157 is locked from the inside.

In the conductor receptacle 115, a penetration guard 117 is provided, which prevents a conductor to be connected from being inserted too far. The penetration guard 117 is arranged at a groove 116 (cf. FIG. 9) and prevents an inserted conductor from passing through, and also secures the current bar 110 inside the mount 108.

In addition, the clamping lever 102 having the clamping edge 122 can be seen, as can the auxiliary lever 104 having the cross connector 105. The clamping lever 104 is held on the mount 108 so as to be rotatable about the axis of the journal 151. In this case, only the insertion guard 156 of the insert device 118 can be seen, which guard reliably prevents a conductor from being inserted into the region of the clamping spring 101 above the conductor receptacle 115 in the open position 144.

Figure 7:
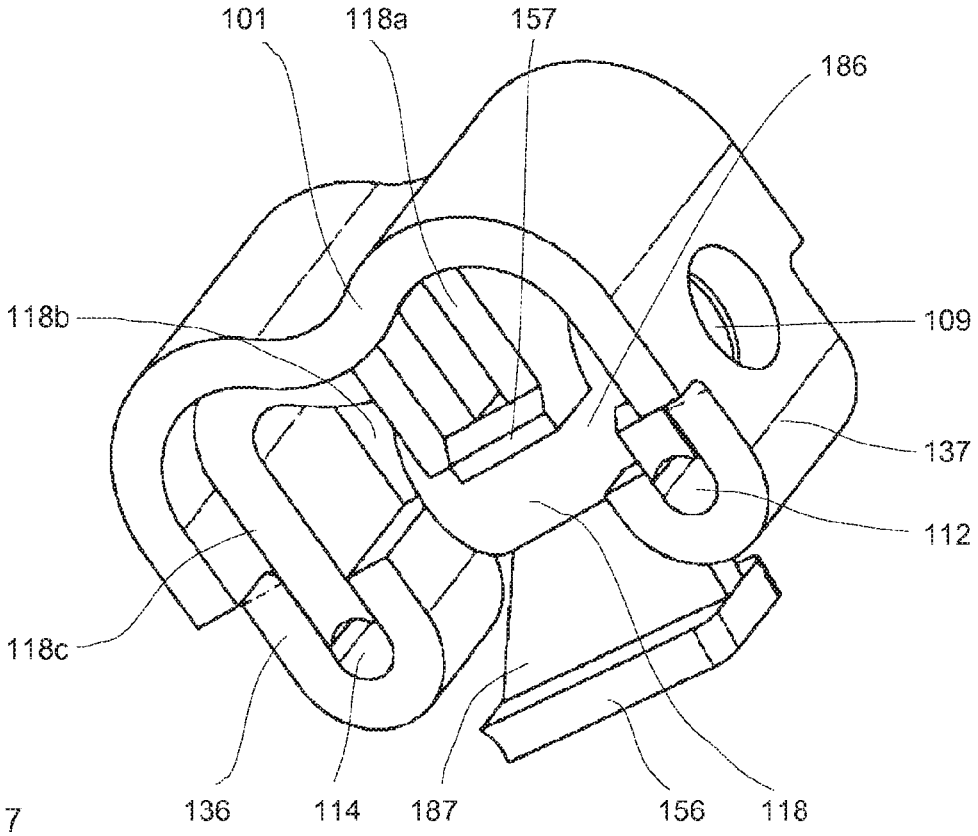
FIG. 7 shows the insert device and the clamping spring of the lead-through terminal according to FIG. 1 and FIG. 6.

FIG. 7 shows the insert device 118 on the clamping spring 101. The insert device 118 is part of a multifunctional inner part 186. The inner part 186 comprises the insert device 118 having the receiving opening 132 (cf. FIG. 9) and the insertion guard 156, as well as the latching lugs in the form of protrusions 157 for fixing the cover 153 in place. The two latching lugs 157 protrude outwards to the side and lock with the two side openings 158 in the cover 153.

The clamping spring 101 provides the necessary clamping force on the lead-through terminal 100. The clamping spring 101, having its generally C-shaped design when viewed from the side, comprises, inside the "C", an insert device 118, here in the form of a plastics insert, and is used as a counter-bearing for a tool 120 (cf. FIG. 9) when the lead-through terminal 100 is being actuated. The clamping spring 101 is loaded with tensile force so that the two legs 136 and 137 of the clamping spring 101 separate when load is applied. The "C" is open in the direction of the conductor receptacle 115.

Figure 8:
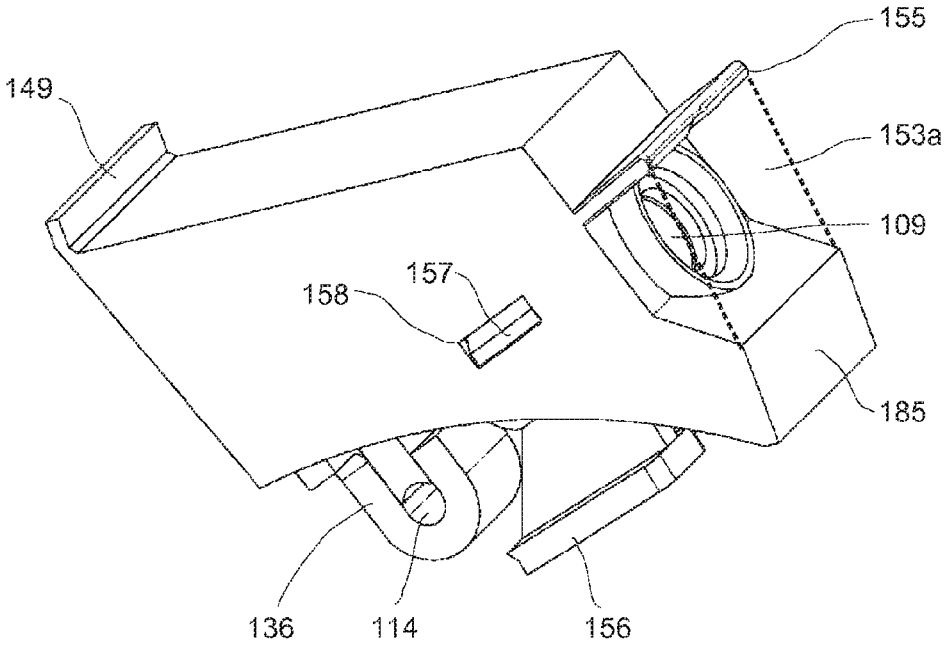
FIG. 8 is a perspective view of the actuation device of the lead-through terminal according to FIGS. 1 and 6.

In this case, the clamping spring 101 is also used as the actuation device 103 or the actuation lever and comprises the plastics insert and the cover 153 shown in FIG. 8, in addition to the clamping spring 101. In the second leg 137 of the clamping spring 101, a tool opening 109 is provided, through which a tool 120 such as a screwdriver can be inserted in order to move the lead-through terminal 100 out of the open state 144 into the clamped state 145 and back again by means of the movement of the screwdriver. The receiving opening 132 or the wall that surrounds the receiving opening 132 in the insert device 118 is used as the counter-bearing during actuation. The insert device 118 comprises an insert body 118*a*, an in particular resilient holding leg 118*c*, and a gap 118*b* therebetween. This allows the insert device 118 to abut the two legs 136, 137 of the clamping spring 101 even in the event of spring movements. The retaining leg 118*c* can be rigidly connected to the first leg 136 of the clamping spring 101 or clamped thereon.

The second pivot pin 114 on the first leg 136 of the clamping spring 101 and the pin 112 on the second leg 137 can be seen. The protrusions 157 lock with the openings 158 in the cover 153. By means of a ridge 187, the planar insertion guard 156 is in particular integral with the insert body 118*a*.

FIG. 8 shows the clamping spring 101 having the insert device 118 and the mounted cover 153. The protrusion 157 on the insert device 118 can be seen at the opening 158. On the lower end, the closure ridge 149 can be seen at the back and the deflector 155 can be seen at the top. If side walls are provided, as indicated by the dashed lines, an insertion funnel is provided for the tool 120.

Figure 9:
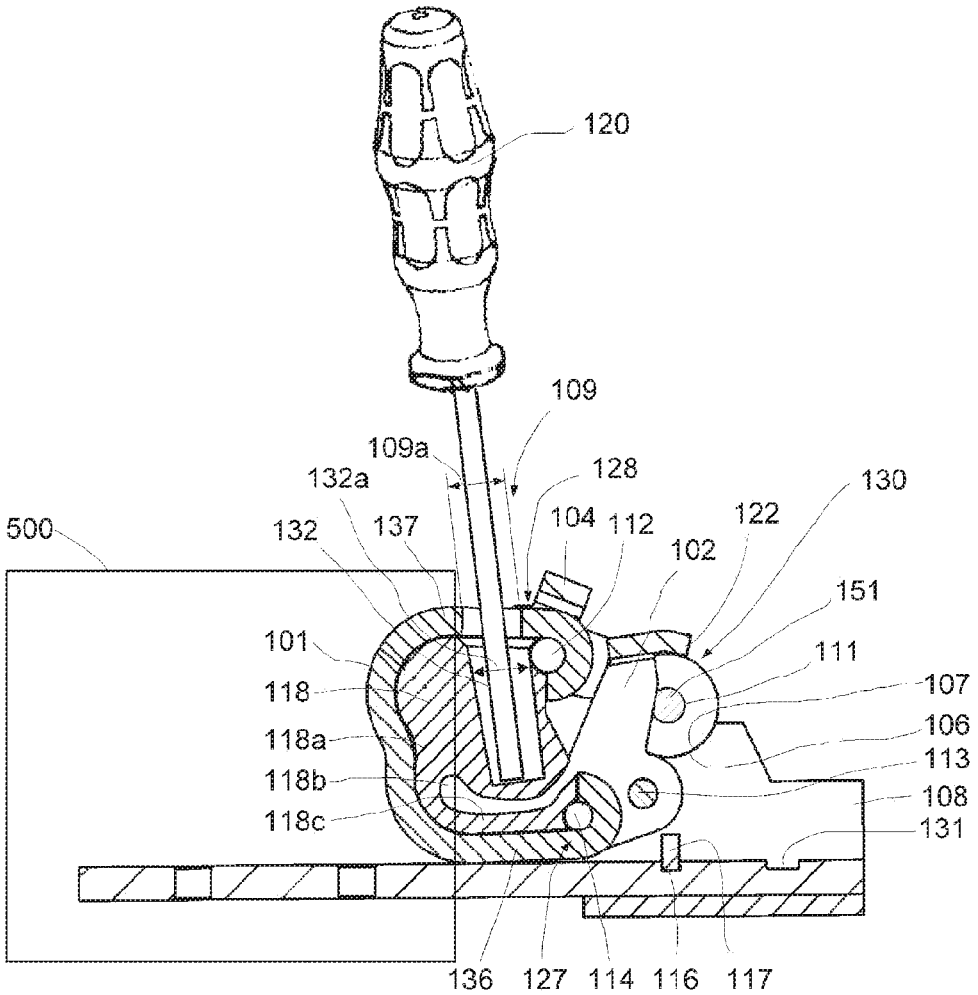
FIG. 9 is a schematic sectional side view of the lead-through terminal without an outer housing.

FIG. 9 is a schematic sectional side view of the lead-through terminal 100 having an insert device 118 formed as a plastics insert. Only the mount 108 is shown, whilst the terminal housing 150 is not depicted in FIG. 9. By pivoting the tool 120 clockwise, i.e. towards the clamping lever 102, the electrical lead-through terminal 100 is moved from the open state 144 shown in FIG. 9 into the clamped state 145.

The first pivot pin 113 and the second pivot pin 114 are held on the clamping lever 102. The clamping lever 102 can generally pivot about the first pivot pin 113 held on the mount 108, and so the clamping edge 122 of the clamping lever 102 is also pivoted when the clamping lever 102 is pivoted.

The first leg 136 of the clamping spring 101 is rotatably held on the second pivot pin 114 of the clamping lever 102. The second leg 137 of the clamping spring 101 can pivot with respect to the first rotary unit 129 (cf. FIGS. 11 and 12) of the auxiliary lever 104. The second rotary unit 130 of the auxiliary lever 104 is rotatably held on the round recess 106 in the mount 108 by means of the round outer shape 107.

Figure 11:
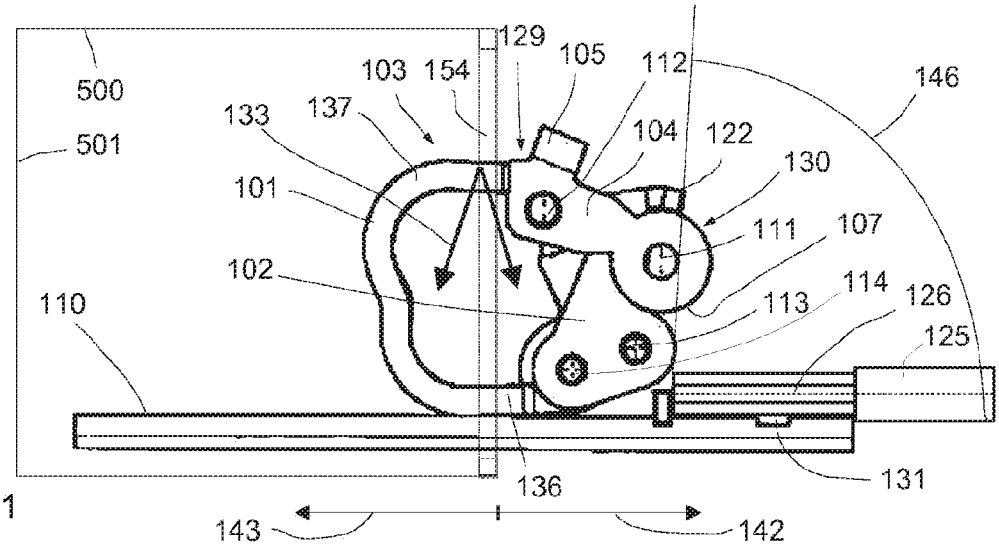
FIG. 11 is a highly schematic side view of the lead-through terminal in the open state.

The insert device 118 can be seen in section in FIG. 9. In order to better identify the other components, the insert guard 156 having the ridge 187 has been omitted in the illustration. A receiving opening 132 for receiving a tool 120 is provided in the insert device 118. In this case, an inner diameter 109*a* of the tool opening 109 in the clamping spring is provided with a larger diameter than the inner diameter 132*a* of the receiving opening 132 in the plastics insert 118. As a result, the clamping spring 101 can be provided for use with different insert devices 118 or with plastics inserts having different receiving openings 132. This allows for the provision of different lead-through terminals 100 in which only the insert device 118 differs and thus the operating angle changes. FIG. 11 is a schematic view of two different angles, which are shown for example by arrows 133.

The clamping lever 102 comprises two parallel side walls, between which the clamping edge 122 is provided. The clamping lever 102 is designed as a single-piece punched bent part in this case.

A groove 116 is provided in the current bar 110, in which groove a rod-shaped penetration guard 117 is formed, which is received in corresponding side openings in the walls 123 of the mount 108. As a result, the current bar 110 is secured in the axial direction, and in addition a penetration guard for a conductor 126 is made possible.

In addition, a groove 131 is provided in the current bar 110 and is arranged at the point where the clamping edge 122 pushes an inserted conductor 126 against the current bar 110. As a result, conductors 126 can be deformed into the groove 131 during the clamping operation, and so effective pull-out protection can be ensured.

In the sectional view according to FIG. 9, the first pin receptacle 127 on the first leg 136 of the clamping spring 101 can be seen in section. In the process, the first pin receptacle 127 encloses the second pivot pin 114 of the clamping lever 102. At the other end of the clamping spring 101, i.e. on the second leg 137, the second pin receptacle 128, which encloses the pin 112 of the first rotary unit 129 of the auxiliary lever 104, can be seen in section.

The guide pin 151 in the hole 111 or the virtual axis of rotation of the second rotary unit 130 of the auxiliary lever 104 can be seen in the section.

Figure 10:
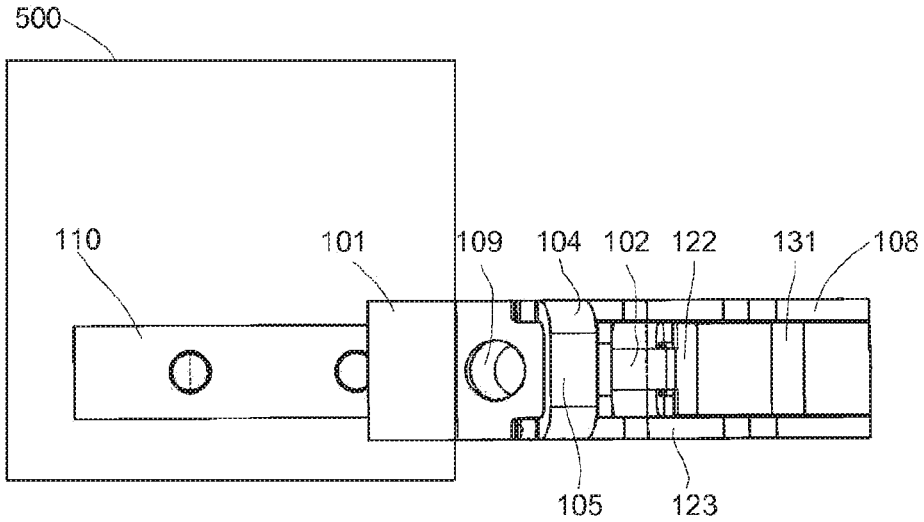
FIG. 10 is a plan view of the lead-through terminal according to FIG. 12.

FIG. 10 is a plan view of the electrical lead-through terminal 100. The tool opening 109 can be seen in the clamping spring 101. The auxiliary lever 104 encloses the second leg 137 of the clamping spring 101 by means of the cross connector 105. The clamping lever 102 comprises the clamping edge 122, which in this case is facing to the right and which engages in the groove 131 in the clamped state or pushes a conductor against the groove 131 in the current bar 110.

In the following, the functioning of the lead-through terminal 100 will be explained with reference to FIG. 11 to 13. FIG. 11 is a schematic view of a cable 125 having an electrical conductor 126. In the illustrations according to FIG. 11 to 13, various parts of the electrical lead-through terminal 100 have been omitted to better illustrate the functioning. The terminal housing 150 has thus also been omitted in FIG. 11 to 13, as has the mount 108. It should be noted, however, that the clamping lever 102 is rigidly connected to the mount 108 by means of the first pivot pin 113. Furthermore, the second rotary unit 130 of the auxiliary lever 104 is in this case immovably supported on the correspondingly round recess 106 in the mount 108 by means of the round outer shape 107, i.e. on the round recess 106 in the mount 108.

To illustrate the movement sequences, a housing 501 of an electrical installation 500 is shown highly schematically and by dashed lines.

Here, the opening angle 146 between the current bar 110 and the clamping edge 122 of the clamping lever 102 is considerably more than 75° and almost 90°. Depending on the geometric design of the clamping lever 102, the opening angle 146 can also be selected to be even larger. Generally, however, this opening angle 146 is sufficient to be able to pivot even particularly rigid conductors 126 of large cross sections into the pivot region 115 from above.

Figure 12:
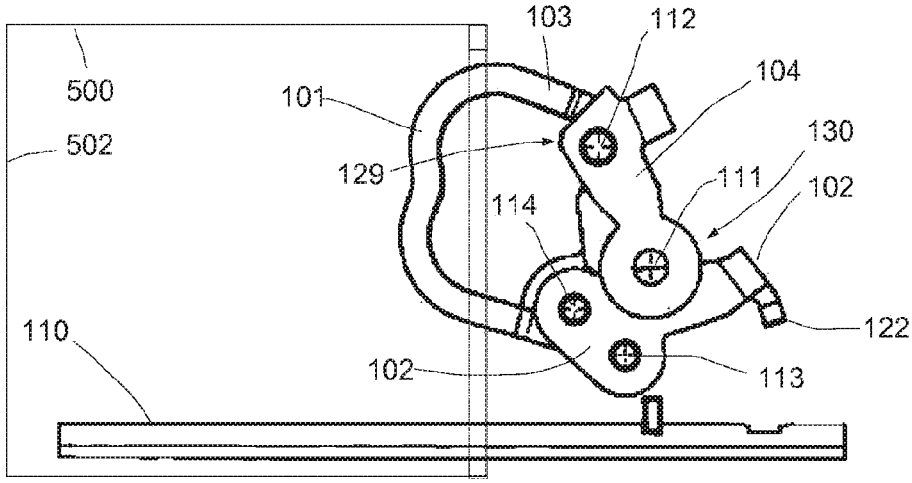
FIG. 12 is a highly schematic side view of the lead-through terminal in an intermediate position.

While FIG. 11 shows the open state 144, FIG. 12 shows an intermediate state, in which the clamping lever 102 has already been pivoted by a considerable amount. This occurs by a tool being inserted into the tool opening 109 in the clamping spring 101 and being pivoted clockwise in the view according to FIG. 11 to 13. When moving from the state shown in FIG. 11 to that shown in FIG. 12, the pivoting takes place practically without force, since the distance between the two legs 136 and 137 of the clamping spring 101 does not change or practically does not change, and thus the spring tension practically does not change. This achieves comfortable operation.

With conductors having very large cross sections, in the state shown in FIG. 12 the clamping edge 122 can almost already be abutting the conductor 126. When moving from the state shown in FIG. 11 to that shown in FIG. 12, the clamping lever 102, the clamping spring 101 and the auxiliary lever 104 pivot in a manner coupled to one another in each case.

Figure 13:
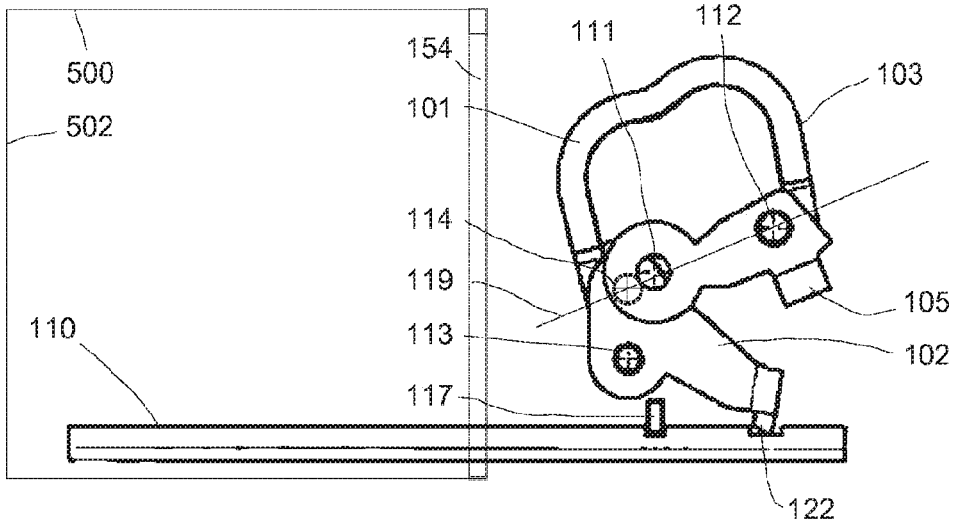
FIG. 13 is a highly schematic side view of the lead-through terminal in the clamped state.

FIG. 13 shows the clamped state 145. It can clearly be seen that zero clamping can also be achieved, in which even conductors having the smallest of cross sections can be clamped. In FIG. 13, the clamping edge 122 abuts the groove 131 in the current bar 110. When pivoting from the state shown in FIG. 12 into the clamped state 145 according to FIG. 13, the clamping spring 101 is tensioned, the distance increasing between the first leg 136 and the second leg 137. Therefore, owing to the sturdy clamping spring 101, a high clamping force is generated.

Comparing FIG. 11 to 13 shows that the actuation device 102 is located on the first side 142 to a greater extent when in the contact position 145 according to FIG. 13 than when in the open position 144 according to FIG. 11, in which at least part of the actuation device 103 and even the most substantial part of the clamping spring 101 extend through the wall feedthrough 154 onto the second side 143. This means that the actuation device 103 and in particular the clamping spring 101 enter the housing 501 of the electrical installation at least in part in the open position 144. In the open position 144, a significant part is located on the second side 142 and thus inside the housing 501. In the process, a significant portion of the volume, the mass and the cross-sectional surface area is located on the second side 143. In the contact position 145, the actuation device 103 remains substantially or even completely on the first side or the outside 142.

Therefore, the installation space of the lead-through terminal can be significantly reduced. Some of the volume required is used on the inside of an electrical installation, where there is typically sufficient space, in particular when another connection is provided on the second side of the lead-through terminal. It is possible, for example, for the current bar to lead on directly.

FIG. 13 shows a self-locking state. When the clamping spring 101 and the auxiliary lever 104 pivot, a dead centre is passed, so in the clamped state 145 the clamping spring 101 is slightly relieved of tension compared with the maximum pretension. This produces a stable state. The self-locking state can be recognised in this case by the connecting line 119 between the pin 112 and the second pivot pin 114 extending almost under the centre of the hole 111 or under the virtual axis of rotation of the second rotary unit 130 of the auxiliary lever 104. As a result, when the electrical lead-through terminal is moved into the open state 144, the clamping spring 101 has to first be pretensioned further in order to overcome the dead centre.

The second pivot pin 114 is shown in dashed lines in FIG. 13 since it is located behind the second rotary unit 130 of the auxiliary lever 104, and thus is not actually visible in this view.

Overall, a very advantageous electrical lead-through terminal 100 is provided. The lead-through terminal is able to be produced in batch production and can be produced from simple components.

The electrical lead-through terminal 100 designed as a tip lever terminal comprises a dynamic lever transmission, in which the clamping edge 122 covers a large path at the start of the closing operation and in which a relatively short path is covered by the tool upon further closing by means of a slight force, which is converted into a high clamping force.

The clamping spring 101, the clamping lever 102, the auxiliary lever 104 and the mount 108 can be produced from punched bent parts. This enables simple and inexpensive production, even for mass production. The maximum opening angle 146 can be very large, so that even the most solid of conductors can be pivoted into the pivot region 115, which is open to the top.

Settling in the spring or other components is reliably prevented, and in principle clamping forces of any size can be applied by an appropriate selection of the wall thicknesses of the clamping spring 101 and the other dimensions.

To mount the auxiliary lever 104 together with the second rotary unit 130 on the mount 108, the second rotary unit 130 can have a round outer contour 107, which engages in a correspondingly round recess 106 in the mount 108. This is possible because no tensile forces occur here, and so a simple plastics journal 151 of the housing 150 is sufficient at the hole 111.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Lead-through terminal 100
Clamping spring 101

Clamping lever 102
Actuation device 103
Auxiliary lever 104
Cross connector 105
Recess 106
Outer shape 107
Mount 108
Tool opening 109
Current bar 110
Hole 111
Pin 112
First pivot pin 113
Second pivot pin 114
Conductor receptacle, pivot region 115
Groove 116
Penetration guard 117
Insert device 118
Insert body 118*a*
Gap 118*b*
Retaining leg 118*c*
Connecting line 119
Tool 120
Clamping edge 122
Side, wall 123
Cable 125
Conductor 126
First pin receptacle 127
Second pin receptacle 128
First rotary unit 129
Second rotary unit 130
Groove 131
Receiving opening 132
Diameter 132*a*
Arrow 133
First leg 136
Second leg 137
First housing portion 140
Second housing portion 141
First side, outside 142
Second side, inside 143
Open state, open position 144
Clamped state, contact position 145
Opening angle 146
Gap 148
Closure ridge 149
Housing, terminal housing 150
Journal 151
Cover 153
Tool access 153*a*
Wall feedthrough 154
Deflector 155
Insertion guard 156
Latching lug, protrusion 157
Opening 158
Inner housing 160
Chamfer 161, 162
Latch opening 165, 166
Outer housing 170
Bearing portion, bearing wall 172
Counter-bearing element, support wall, wall 173
Wall 174
Lug 177, 178
Wall 185
Multi-functional inner part 186
Ridge 187
Locking system 201
Latching direction, first direction 202
Transverse direction 204
Latching unit 210
Latching arm 211
Groove 212,213
Oblique surface 214
Leg 215
Free end 216
Engagement unit 217
Latching unit 220
Latching connector 221
Latching body 222
Cuneiform shape 223
Oblique surface 224
Clip/connector 225
Groove 226
Latching toothing 227
Electrical installation 500
Housing 501
Wall 50

The invention claimed is:

1. A lead-through terminal for connecting a conductor so as to conduct electricity, the lead-through terminal comprising:

a terminal housing having a bearing portion configured to abut a wall of an electrical installation when in an installed state, the bearing portion defining on the terminal housing a first housing portion on a first side and a second housing portion on a second side of the bearing portion, a wall feedthrough being provided on the bearing portion, and a pivotable actuation device being provided on the terminal housing, the actuation device being configured to clamp the conductor in a contact position on a current bar and to release the conductor when in an open position, wherein the actuation device is located on the first side to a greater extent when in the contact position than when in the open position, in which the actuation device extends through the wall feedthrough onto the second side at least in part.

2. The lead-through terminal of claim 1, wherein the actuation device is located inside the first housing portion to a greater extent when in the contact position than when in the open position.

3. The lead-through terminal of claim 1, wherein the second housing portion is configured to be used as an attachment portion and comprises at least one latching unit.

4. The lead-through terminal of claim 3, wherein the at least one latching unit comprises a resilient latching arm that is U-shaped at its free end, and wherein a returning leg of the free end comprises at least one latching element.

5. The lead-through terminal of claim 3, wherein the second housing portion comprises at least one counter-bearing element configured to locally support the at least one latching unit.

6. The lead-through terminal of claim 5, wherein the at least one counter-bearing element comprises a wall element.

7. The lead-through terminal of claim 1, wherein the second housing portion forms a peripheral housing contour that covers the actuation device laterally when in the open position.

8. The lead-through terminal of claim 7, wherein the peripheral housing contour comprises at least one counter-bearing element and at least one latching unit.

9. The lead-through terminal of claim 1, wherein the actuation device comprises a cover having a tool access.

10. The lead-through terminal of claim 9, wherein the cover is attached to an insert device.

11. The lead-through terminal of claim 10, wherein the cover is attached to at least one latching lug of the insert device.

12. The lead-through terminal claim 1, wherein the actuation device comprises a clamping lever configured to clamp the conductor and a clamping spring configured to apply a clamping force.

13. The lead-through terminal of claim 12, wherein the clamping spring comprises a first leg and at least one second leg, and is hingedly coupled to the clamping lever by the first leg and hingedly coupled to an auxiliary lever by the second leg, and wherein the clamping lever and the auxiliary lever are pivotally arranged on a mount.

14. The lead-through terminal of claim 13, wherein a first pivot pin and at least one second pivot pin spaced apart therefrom are arranged on the clamping lever, wherein the clamping spring has a first pin receptacle and at least one second pin receptacle spaced apart therefrom, and wherein an auxiliary lever, which comprises a first rotary unit and at least one second rotary unit spaced apart therefrom, is provided.

15. The lead-through terminal claim 12, wherein an opening angle between the current bar and the clamping lever in the open state is greater than 45°.

16. The lead-through terminal of claim 15, wherein an opening angle is greater than 60°.

17. The lead-through terminal of claim 16, wherein an opening angle is greater than 75°.

18. An electrical installation, comprising:

a housing having at least one wall and at least one lead-through terminal held thereon configured to connect a conductor to a current bar so as to conduct electricity, the lead-through terminal:

a terminal housing having a bearing portion that abuts the at least one wall at least in part, the bearing portion defining on the terminal housing a first housing portion on a first side and a second housing portion on a second side of the bearing portion;

a wall feedthrough being-provided on the bearing portion; and a pivotable actuation device provided on the terminal housing, the actuation device being configured to clamp the conductor on the current bar in a contact position and to release the conductor in an open position, wherein the actuation device is located on the first side to a greater extent when in the contact position than when in the open position, in which the actuation device extends through the wall feedthrough onto the second side at least in part.

19. The electrical installation claim 18, wherein the first housing portion is provided at least substantially outside the housing and the second housing portion is provided at least substantially inside the housing.

* * * * *